US007591669B1

(12) United States Patent
Peng

(10) Patent No.: US 7,591,669 B1
(45) Date of Patent: Sep. 22, 2009

(54) BOARD-TO-BOARD CONNECTOR

(75) Inventor: Yung-Chi Peng, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/190,794

(22) Filed: Aug. 13, 2008

(51) Int. Cl.
*H01R 3/00* (2006.01)

(52) U.S. Cl. ..... 439/489; 439/910

(58) Field of Classification Search ..... 439/488, 439/489, 910, 947
See application file for complete search history.

(56) References Cited

U.S. PATENT DOCUMENTS 5,558,540 A * 9/1996 Kato et al. ..... 439/637
5,697,799 A * 12/1997 Consoli et al. ..... 439/181
5,915,975 A * 6/1999 McGrath ..... 439/74
6,077,121 A * 6/2000 Wu ..... 439/607.05
6,296,500 B1 * 10/2001 Liao ..... 439/188
6,431,893 B1 * 8/2002 Chang et al. ..... 439/188
7,074,085 B2 * 7/2006 Chen ..... 439/607.36
7,223,107 B2 * 5/2007 Mao ..... 439/83
7,445,466 B1 * 11/2008 Peng ..... 439/74
2004/0161965 A1 * 8/2004 Bricaud et al. ..... 439/489

* cited by examiner

*Primary Examiner*—James Harvey
(74) *Attorney, Agent, or Firm*—WPAT, P.C.; Anthony King; Kay Yang

(57) ABSTRACT

A board-to-board connector adapted to be mounted to a printed circuit board includes a housing and at least one row of terminals. The housing defines at least one longwise row of cavities and at least one checking window extending longwise adjacent the row of cavities and penetrating the housing. The terminals are received in the corresponding cavities. Each of the terminals has a soldering portion adapted for being soldered to the printed circuit board. The soldering portions stretch into the corresponding checking window so as to check the solderability thereof with the printed circuit board in order to ensure that the terminals are soldered to the printed circuit board firmly.

5 Claims, 4 Drawing Sheets

BOARD-TO-BOARD CONNECTOR

BACKGROUND OF THE INVENTION

1. Field of the Invention

The present invention generally relates to a board-to-board connector, and more particularly to a board-to-board connector capable of checking terminals' solderability.

2. The Related Art

With the development of electronic field, electronic products are microminiaturized more and more, thus a board-to-board connector capable of receiving a plurality of rows of terminals comes with the tide of the fashion. Traditionally, the board-to-board connector includes a receptacle connector and a plug connector mating with each other. The receptacle connector includes a receptacle housing and a plurality of first terminals received in the receptacle housing. The first terminals each have a first soldering portion for being soldered to a female printed circuit board. The plug connector includes a plug housing and a plurality of second terminals received in the plug housing. The second terminals each have a second soldering portion for being soldered to a male printed circuit board. When the plug connector engages with the receptacle connector, the second terminals contact the corresponding first terminals to make the printed circuit boards electrically interconnect each other.

However, because the first soldering portions of the first terminals in inside rows are disposed on a bottom surface of the receptacle housing and the second soldering portions of the second terminals in inside rows are disposed on a top surface of the plug housing, when the terminals are soldered to the corresponding printed circuit boards, whether the soldering portions of the terminals in the inside rows are firmly soldered to the corresponding printed circuit boards or not can't be checked. Therefore, a board-to-board connector capable of checking the terminals' solderability with the corresponding printed circuit boards is required.

SUMMARY OF THE INVENTION

An object of the present invention is to provide a board-to-board connector which is adapted to be mounted to a printed circuit board and can check terminals' solderability.

To achieve the above mentioned objects, the board-to-board connector includes a housing and at least one row of terminals. The housing defines at least one longwise row of cavities and at least one checking window extending longwise adjacent the row of cavities and penetrating the housing. The terminals are received in the corresponding cavities. Each of the terminals has a soldering portion adapted for being soldered to the printed circuit board. The soldering portions stretch into the corresponding checking window so as to check the solderability thereof with the printed circuit board in order to ensure that the terminals are soldered to the printed circuit board firmly.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE PREFERRED EMBODIMENT

Figure 1:
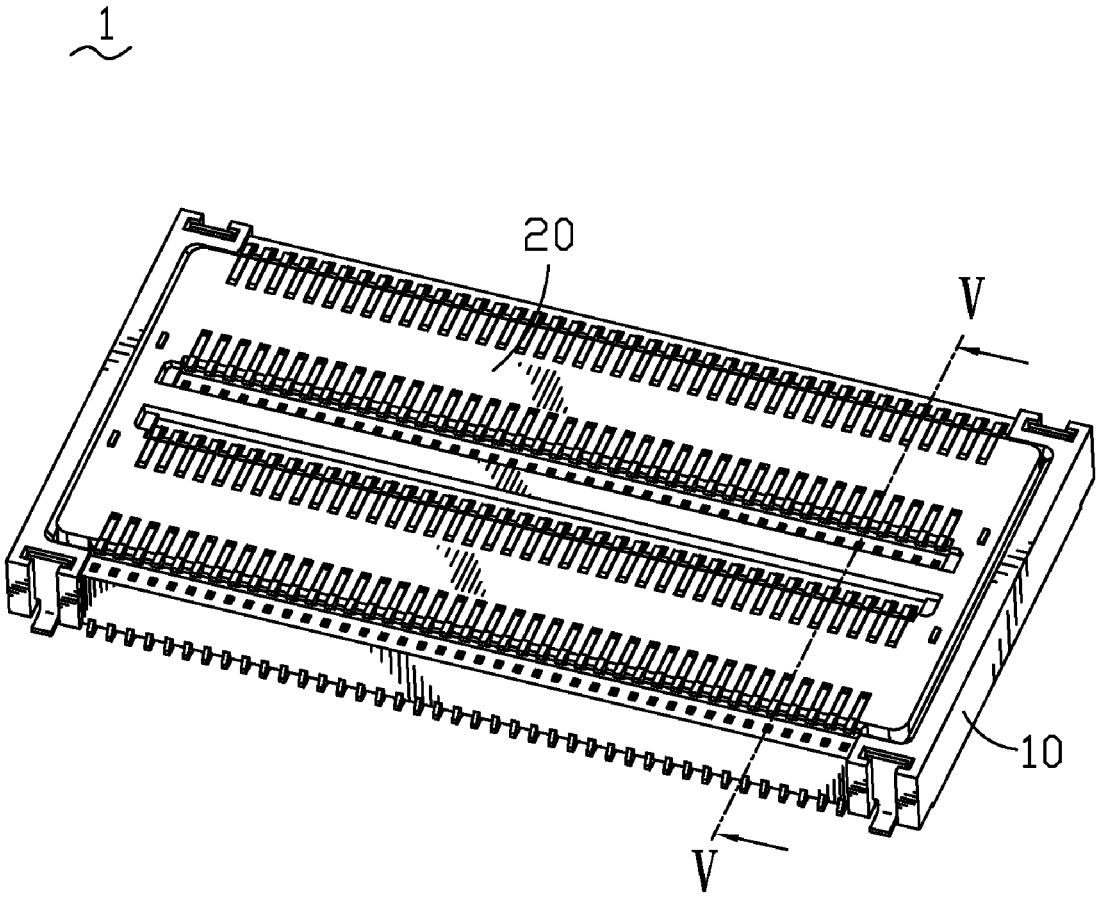
FIG. 1 is a perspective view of a board-to-board connector in accordance with the present invention.
Figure 2:
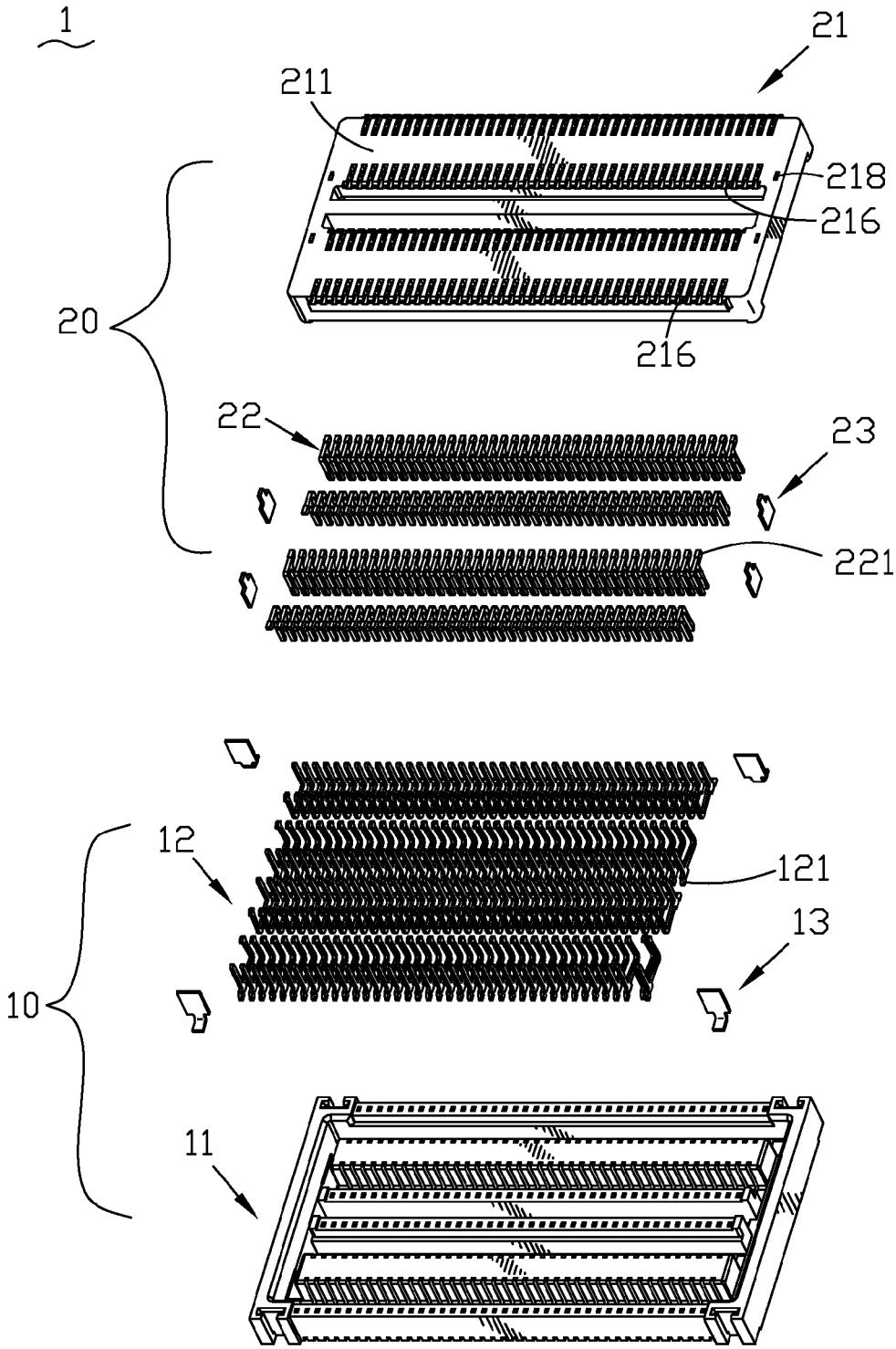
FIG. 2 is an exploded perspective view of the board-to-board connector of FIG. 1.

Referring to FIG. 1 and FIG. 2, a board-to-board connector 1 in accordance with the present invention includes a receptacle connector 10 and a plug connector 20 which are mounted to a pair of printed circuit boards (not shown) to electrically interconnect the printed circuit boards.

Referring to FIG. 2 again, the receptacle connector 10 includes a receptacle housing 11, a plurality of rows of first terminals 12 each having a first soldering portion 121 and four first latches 13 received in the receptacle housing 11 respectively.

Figure 3:
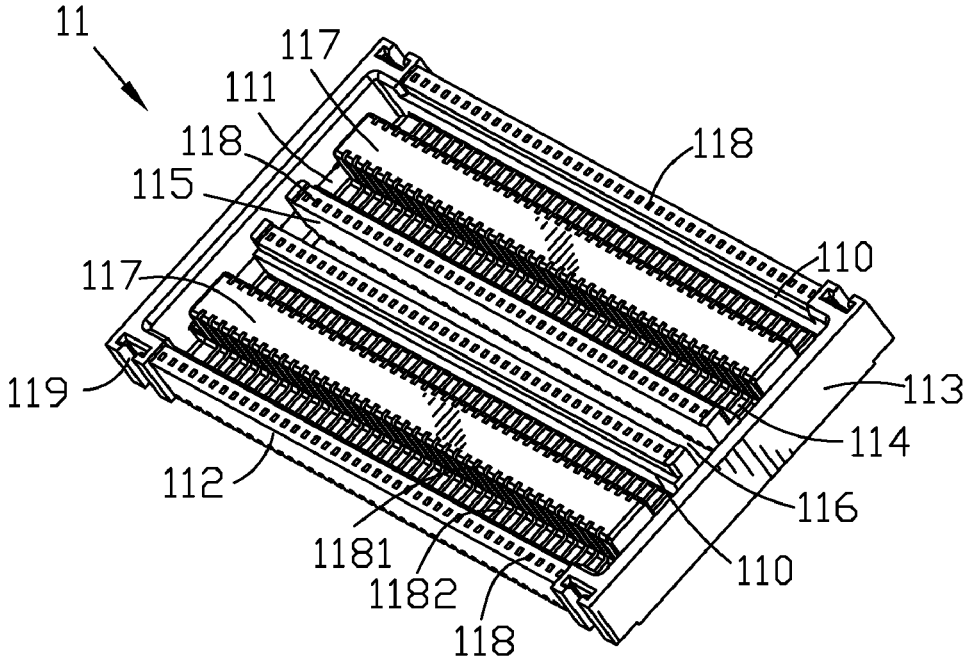
FIG. 3 is a perspective view of a receptacle housing of the board-to-board connector of FIG. 2.

Referring to FIG. 3, the receptacle housing 11 is of a rectangular configuration and has a base board 111. Two opposite sides of the base board 111 protrude upward to form a pair of first sidewalls 112 extending longwise. Two opposite ends of the base board 111 protrude upward to form a pair of second sidewalls 113. A middle of the base board 111 defines a rectangular first checking window 116 therethrough which parallels the first sidewalls 112 and whose two ends are apart from the corresponding second sidewalls 113. The base board 111 protrudes upward to form a pair of third sidewalls 115 adjacent to two opposite sides of the first checking window 116. A receiving recess 114 is formed between the first sidewall 112 and the third sidewall 115. The base board 111 defines two ribs 117 extending longwise and respectively located between the first sidewalls 112 and the corresponding third sidewalls 115. Two ends of each of the ribs 117 are apart from the corresponding second sidewalls 113. A prop platform 110 is formed on one side of each of the third sidewalls 115 opposite each other and one side of each of the first sidewalls 112 facing each other, the prop platform 110 extends along a longwise direction at bottom thereof. Two ends of the outside of the first sidewalls 112 define a fixing gap 119 respectively. The receptacle housing 11 defines a plurality of longwise rows of first cavities 118 which further extend to form perforations 1181 and fillisters 1182. The perforations 1181 are vertically defined at two opposite sides of the ribs 117 and are arranged at regular intervals along a longwise direction thereof. The first cavities 118 are vertically defined in the first sidewalls 112 and the third sidewalls 115 and are in one-to-one accordance with the perforations 1181. The fillisters 1182 are opened in the base board 111 to connect the perforations 1181 and the corresponding first cavities 118 and communicate with the receiving recess 114. The first cavities 118 in the first sidewalls 112 penetrate a bottom of the outside of the respective first sidewalls 112, the first cavities 118 in the third sidewalls 115 penetrate a bottom of the inside of the respective third sidewalls 115 to communicate with the first checking window 116.

Referring to FIG. 2 again, the plug connector 20 includes a plug housing 21 mating with the receptacle housing 11, a plurality of rows of second terminals 22 each having a second soldering portion 221 and four second latches 23 received in the plug housing 21 respectively.

Figure 4:
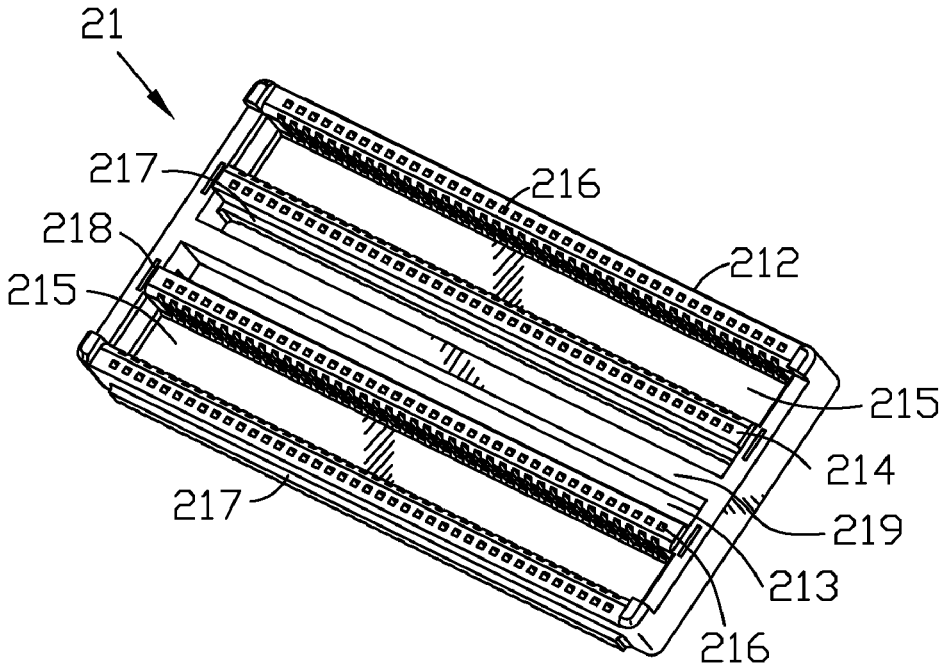
FIG. 4 is a perspective view of a plug housing of the board-to-board connector of FIG. 2.

Referring to FIGS. 2 and 4, the plug housing 21 is of a rectangular configuration and has a base body 211. A middle of the base body 211 defines two rectangular second checking windows 213 therethrough, which extend longwise and parallel each other. Accordingly, a bridge 219 is formed between the two second checking windows 213. The front and the rear of a bottom of the base body 211 respectively define a rectangular receiving channel 215 paralleling the bridge 219. Accordingly, two second sidepieces 214 each are formed between the receiving channel 215 and the neighboring second checking window 213, two first sidepieces 212 are formed at two sides of the base body 211. The inside of the second sidepieces 214 and the outside of the first sidepieces 212 respectively define an anti-shake step 217 extending along a longwise direction at top thereof. The first sidepieces 212 and the second sidepieces 214 define a plurality of second cavities 216 arranged at regular intervals along a longwise direction thereof and communicating with the corresponding receiving channels 215. A top of each of the second cavities 216 in the first sidepieces 212 penetrates the outside of the corresponding anti-shake steps 217, a top of each of the second cavities 216 in the second sidepieces 214 penetrates the outside of the corresponding anti-shake steps 217 to communicate with the respective second checking windows 213. Two ends of the base body 211 respectively define two fixing holes 218 therethrough vertically.

Figure 5:
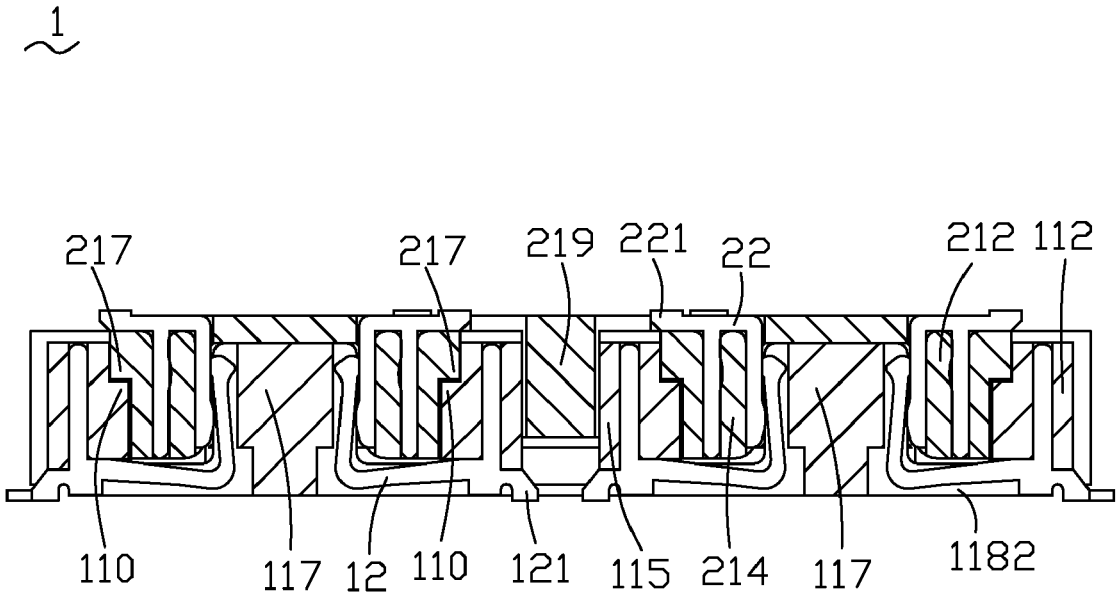
FIG. 5 is a cross-sectional view of the board-to-board connector along line V-V of FIG. 1.

Referring to FIG. 1, FIG. 2 and FIG. 5, when the receptacle connector 10 is assembled, the first latches 13 are embedded in the corresponding fixing gaps 119 of the receptacle housing 11. The first terminals 12 are received in the respective first cavities 118, the perforations 1181 and the fillisters 1182, and the first soldering portions 121 stretch out of a bottom of the base board 111. In use, the receptacle connector 10 is mounted to one of the printed circuit boards. The first soldering portions 121 of the first terminals 12 in two inside rows partially lie in the first checking window 116, thus whether the first soldering portions 121 in the inside rows are firmly soldered to the corresponding printed circuit board or not can be checked through the first checking window 116.

When the plug connector 20 is assembled, the second latches 23 are embedded in the corresponding fixing holes 218 of the plug housing 21. The second terminals 22 are received in the respective second cavities 216 and the second soldering portions 221 stretch out of a top of the base body 21. In use, the plug connector 20 is mounted to the other printed circuit board. The second soldering portions 221 of the second terminals 22 in two inside rows partially lie in the corresponding second checking windows 213, thus whether the second soldering portions 221 in the inside rows are firmly soldered to the corresponding printed circuit board or not can be checked through the corresponding second checking windows 213.

When the plug connector 20 engages with the receptacle connector 10, the plug connector 20 is received in the receiving recess 114 of the receptacle connector 10. The ribs 117 are inserted in the respective receiving channels 215. The third sidewalls 115 are inserted in the corresponding second checking windows 213 and the bridge 219 is inserted between the third sidewalls 115. The first terminals 12 contact the corresponding second terminals 22 to make the printed circuit boards electrically interconnect each other. The anti-shake steps 217 abut against the respective prop platforms 110 to prevent the receptacle connector 10 and the plug connector 20 from separating each other under shaking.

As described above, while the board-to-board connector 1 is mounted to the printed circuit boards, the solderability of the soldering portions in the two inside rows can be checked through the first checking window 116 and the second checking windows 213 so as to ensure that the terminals are soldered to the corresponding printed circuit boards firmly.

What is claimed is:

1. A board-to-board connector, comprising a receptacle connector adapted to be mounted to a printed circuit board, the receptacle connector having:

a receptacle housing having a base board, two first sidewalls protruding upward from two opposite sides of the base board, at least one pair of adjacent third sidewalls being substantially parallel to the first sidewalls and disposed between the two first sidewalls, a first checking window penetrating the base board and being located between the pair of the adjacent third sidewalls, the third sidewalls defining a plurality of first cavities therein, a receiving recess being formed between the first sidewall and the third sidewall; and a plurality of first terminals received in the corresponding first cavities, each of the first terminals having a first soldering portion adapted for being soldered to the printed circuit board, the first soldering portion stretching into the first checking window so as to check the solderability thereof with the printed circuit board;

further comprising a plug connector adapted to be mounted to a respective printed circuit board, the plug connector having:

a plug housing mating with the receptacle housing and defining at least two longwise rows of second sidepieces respectively fitted in the corresponding receiving recess, each of the second sidepieces longwise defining a plurality of second cavities therein;

a plurality of second terminals received in the corresponding second cavities, each of the second terminals having a second soldering portion adapted for being soldered to the respective printed circuit board; and wherein the plug housing defines a second checking window extending longwise and penetrating the plug housing, the second checking window is located between the two second sidepieces, the second soldering portions stretch into the second checking window so as to check the solderability thereof with the respective printed circuit board, the third sidewalls of the receptacle housing are inserted in the second checking window.

2. The board-to-board connector as claimed in claim 1, wherein the plug connector engages with the receptacle connector and the second terminals electrically contact the corresponding first terminals.

3. The board-to-board connector as claimed in claim 1, wherein the base board of the receptacle housing protrudes upward to form two ribs paralleling the first sidewalls, the ribs are respectively located between the first sidewall and the corresponding third sidewall, the first cavities extend to a corresponding outside of each of the ribs.

4. The board-to-board connector as claimed in claim 1, wherein the plug housing has a longwise bridge dividing the second checking window into two parts, the bridge is inserted between the pair of the third sidewalls.

5. The board-to-board connector as claimed in claim 1, wherein a prop platform is formed on one side of each of the third sidewalls opposite each other and one side of each of the first sidewalls facing each other, two opposite outsides of the plug housing and two facing insides thereof adjacent to the second checking window each define an anti-shake step abutting against the corresponding prop platform.

* * * * *